United States Patent [19]

Barnebey

[11] 4,038,154

[45] July 26, 1977

[54] PILE FURNACE

[75] Inventor: Herbert L. Barnebey, Columbus, Ohio

[73] Assignee: Barnebey-Cheney Co., Columbus, Ohio

[21] Appl. No.: 402,970

[22] Filed: Oct. 3, 1973

Related U.S. Application Data

[63] Continuation of Ser. No. 188,213, Oct. 12, 1971, abandoned.

[51] Int. Cl.[2] ..... C10B 51/00

[52] U.S. Cl. ..... 202/93; 202/108; 202/121; 202/210; 201/27; 201/40; 252/421

[58] Field of Search ..... 201/27, 29, 25, 2.5, 201/37, 34, 40, 44; 202/210, 121, 93, 108; 252/421; 110/8 B, 12

[56] References Cited

U.S. PATENT DOCUMENTS

| | | | |
|---|---|---|---|
| 2,560,767 | 7/1951 | Huff | 201/29 |
| 3,475,319 | 10/1969 | MacLaren | 201/34 |
| 3,525,674 | 8/1970 | Barnebey | 201/27 |

*Primary Examiner*—Wilbur L. Bascomb, Jr.
*Attorney, Agent, or Firm*—Harness, Dickey & Pierce

[57] ABSTRACT

A furnace and process for carrying out the carbonizing and/or activating of charcoal and similar operations includes vent means, which may be in the general shape of one or more elongated chambers of tunnels, that acts in combination with air admission means to determine the location, size, shape, and temperature of one or more hot zones within a pile of particulate combustible material. The vent means acts to (1) expedite the venting of gases generated in the mass of particulate material being treated, (2) collect a portion of the released gases in one or more chambers or zones, and (3) provide a space to burn any combustible gases at substantially controlled temperatures and in heat transfer relationship with the particulate mass.

1 Claim, 6 Drawing Figures

INVENTOR.
Herbert L. Barnebey

BY
Harness, Dickey & Pierce
ATTORNEYS.

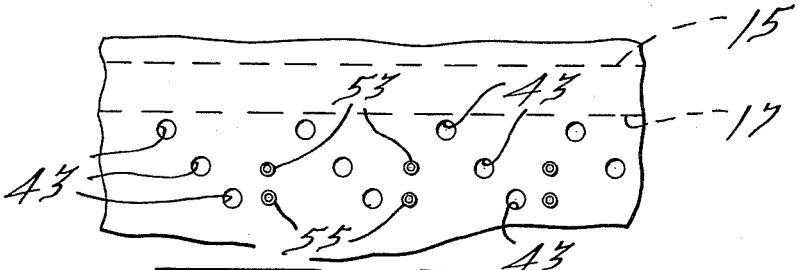
FIG. 2.
FIG. 3.
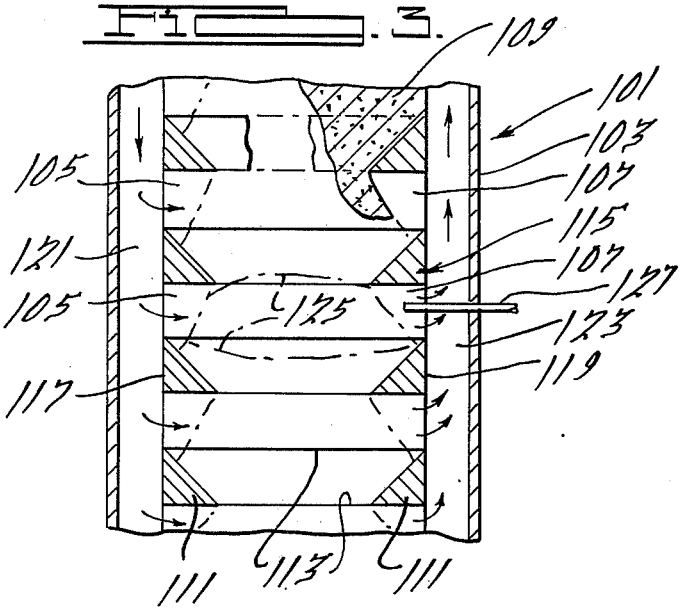
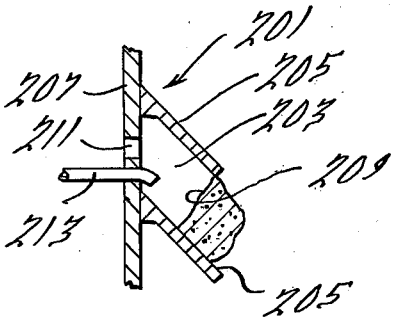
FIG. 4.
FIG. 5.
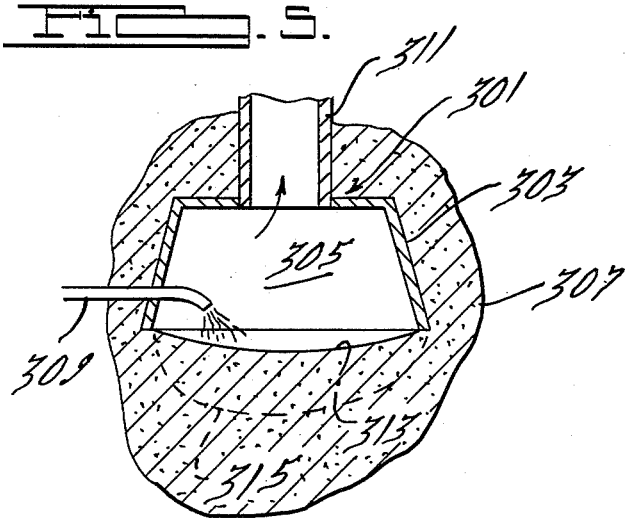
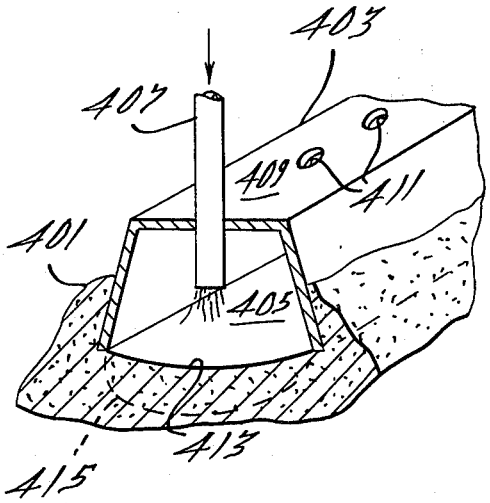
FIG. 6.
INVENTOR.
Herbert L. Barnebey
BY
Harness, Dickey & Pierce
ATTORNEYS.

PILE FURNACE

This a continuation of application Ser. No. 188,213, filed Oct. 12, 1971, and now abandoned.

BRIEF SUMMARY OF THE INVENTION

The invention relates to a combustion method for particulate material and a furnace structure containing features that are beneficial in carbonization and/or activation of carbonaceous material, such as wood, nut shells, coke and coal, as well as the recarbonization, reactivation, drying, or outgassing thereof, in the burning and disposal of solid waste, in the distillation of oil shale, in the production of fuel or synthesis gas, etc., one of the advantages of the furnace structure or method being that they are relatively insensitive to the moisture content, the size, and nature of the particulate matter being treated by means of the method or furnace.

The invention provides a method and means for use with or in a pile or mass of carbonaceous material (or the like) that facilitates the removal of gases evolved from the material during heating of the material. This means is preferably in the form of one or more chambers adjacent a surface of the mass which collects the released gases as evolved and communicates with an exhaust stack so that the gases can be evacuated from the material.

DESCRIPTION OF THE DRAWINGS

FIG. 2 is a view, broken away, taken along line 2—2 of FIG. 1;

FIG. 3 is a schematic vertical section, broken away, of another form of furnace embodying the invention;

FIG. 4 is a partial section showing another tunnel forming sturcture — the air inlet and gas outlet being shown in the same plane to facilitate illustration;

FIG. 5 is a broken away section showing another form of vent and construction chamber; and FIG. 6 is a broken away perspective view of another form of tunnel structure.

DESCRIPTION OF THE INVENTION

Figure 1:
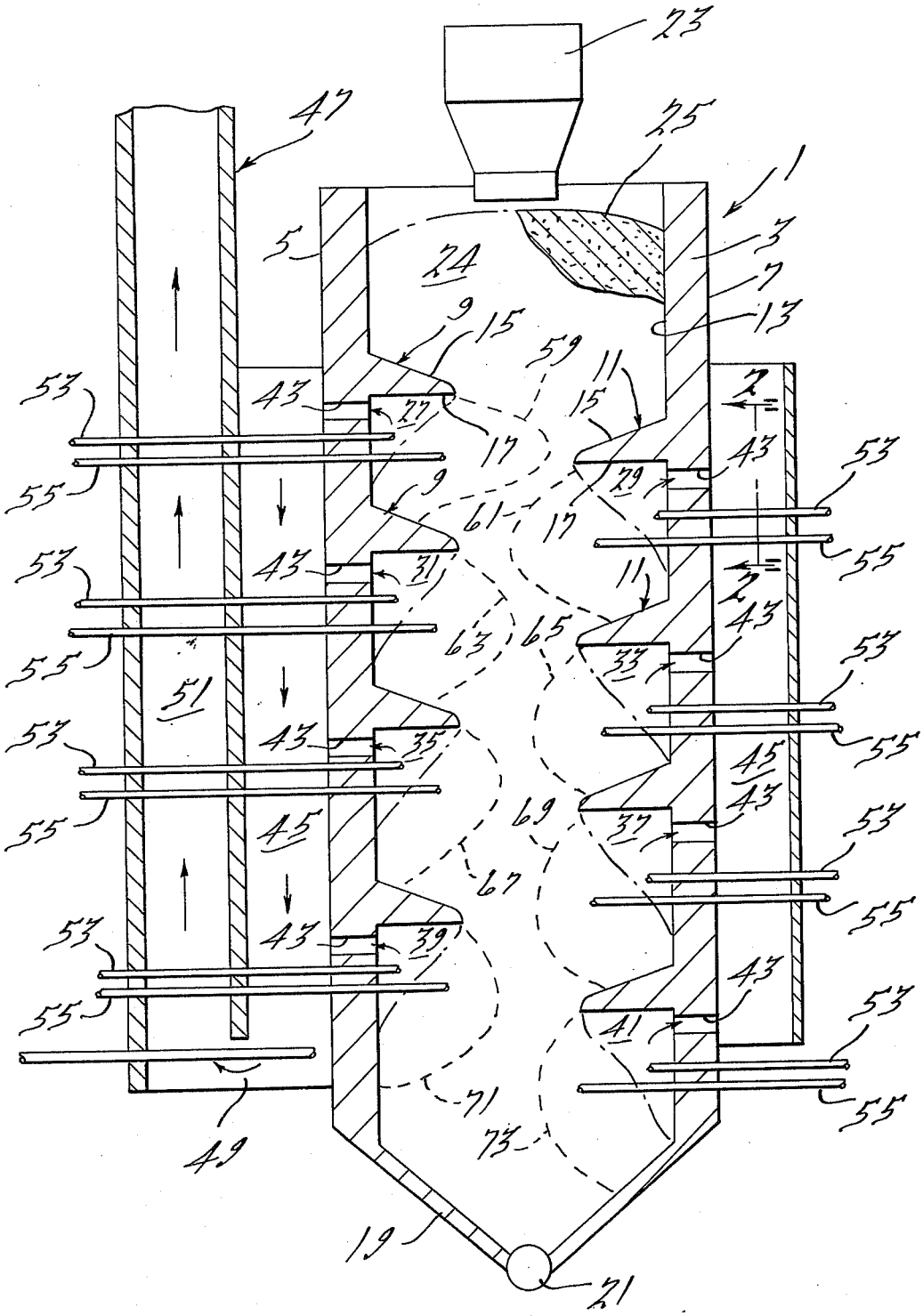
FIG. 1 is a schematic vertical section, with parts rotated into the plane of the drawing to facilitate illustration, of one form of furnace construction embodying the invention.

In FIG. 1, a furnace 1 has an outer casing or shell 3 which, within the broad purview of the invention, may be constructed of various materials and may be of various cross-sectional shapes, sizes, heights, and orientations. It is illustrated in the drawings as having refractory side walls 5 and 7 which are respectively provided with several inwardly projecting ledges 9 and 11 that may be vertically staggered as shown with respect to opposite sides of the furnace and which extend horizontally into the vertical chamber 13 that is defined by the casing 3. The upper surfaces 15 of the ledges are preferably inclined on an angle steeper that the angle of repose of the particulate material being treated, whereas the bottom surfaces 17 may be horizontal as shown or another inclination that leaves adequate vent chamber space.

The furnace 1 has a suitable bottom structure 19 which may be trough shaped as shown so that particulate carbonaceous material which is piled on it in the furnace will slide by gravity to a discharge screw mechanism 21 or other suitable discharge contruction to insure a desired rate and type of flow of material through and out of the furnace.

At the top of the furnace there is a suitable feed device such as a desired type of feed elevator, a recycling arrangement connected to discharge mechanism 21, or the hopper mechanism 23 which is illustrated.

When the furnace 1 is filled with a mass of particulate combustible material 24 to a suitable height, such as the level indicated by the line 25, the material will be slidably supported in part upon the various inclined surfaces 15. The angle of repose of the material is such, however, that a series of empty elongated spaces or tunnel-like chambers 27, 29, 31, 33, 35, 37, 39 and 41 are formed below the various bottom faces 17 of the ledges. As indicated in the drawing, these spaces are roughly triangular in shape in the particular structure illustrated. As will become more apparent hereinafter, these spaces act as collection zones for gases released during treatment (e.g. carbonization or activation) of the particulate material and they facilitate removal of gases from the material.

Each of the spaces 27 through 41 has suitable outlet passage means 43 associated with it which is illustrated as holes extending through the respective side walls 5 and 7 and opening into a downflow section 45 of an exhaust gas stack 47. A passage 49 connects the downflow section 45 with the upflow section 51 of the stack which terminates at a desired height above the furnace. Means for admission of combustion air such as a hole or the illustrated air lance 52 opens into the bottom end of the downflow stack section 45 to provide a means for burning in the stack any unburned combustibles that are exhausted from the furnace 1 so that unburned materials are not discharged into the atmosphere.

While various other combustion initiating and controlling arrangements are within the spirit of the invention, there is illustrated for each of the zones 27 through 41 an air lance 53 that opens into the gas collecting space to provide oxygen for combustion of any unburned gases released from the material 24. Air lances 55 are also illustrated as running adjacent to the lances 53 and terminating inside of the mass of particulate material. The lances 55 provide means for injecting air or oxygen directly into the pile of material at various levels and locations and also provide a means for introducing steam, fuel, or water into the mass as desired to control operation of the furnace, it being apparent that the operation of the different zones and levels can be regulated independently of each other.

In actual operation, the furnace 1 is characterized by a plurality of relatively small stationary hot zones located within the mass of material being treated in and flowing through the furnace. Thus, adjacent the zone 27 there is a zone 59 as indicated by the dotted lines in FIG. 1, and similarly adjacent zones 29, 31, 33, 35, 37, 39, and 41 are zones 61, 63, 65, 67, 69, 71, and 73 respectively. It is apparent that the pressure of gases evolved in the hot zones will be higher than the pressure adjacent the outlets 43 to the tunnels so that gases will flow toward the tunnel and that the size and temperature of each zone can be controlled by means of the fluid admitted through the lances 53 and 55, in combination with the rate of material flow through the furnace. Thus, within the one furnace chamber 13, various processes can be carried out on a mass of material, such as drying (which would ordinarily be conducted adjacent the top of the chamber 13), carbonization, activation, recarbonization, outgassing, etc. In carbonizing-activating application of the furnace 1, the upper level above the zone 59 would normally be used for drying and, in the case of particularly wet material, the zone 59 may be withdrawn from use so that the space it occupies is also used for drying. Water vapor and released gases can then escape through chamber 27. Zones such as 59, 61 and 63 may be used for carbonization; and zones 65, 67 and 69 may be used in a typical application for activation which is carried out at a somewhat higher temperature than carbonization. The lower part of the furnace, such as that including zones 71 and 73, may be turned off and used for activation without external combustion and for cooling of the material to some extent before it reaches the discharge mechanism 21.

It will be noted that the pressure of the various collection zones 27 and 29, in contact with the various interfaces 57 of the adjacent charcoal combustion zones, provides substantial surface areas through which volatiles released by heating of the material in the furnace can readily escape from the particulate mass. It is contemplated that the furnace will be regulated in accordance with the method of U.S. Pat. No. 3,525,674 so that substantially all of the released volatiles will, as evolved, be burned within the various operating zones 59 through 73. The presence of the vent chambers 27 through 41 facilitates this burning of volatiles and facilitates removal of all gases from the mass before cracking, deposition of tars, etc., occurs. Any combustible volatiles which escape the mass and pass into the various collection chambers 27 through 41 may be burned within them as combustion chambers and in heat transfer relationship with the combustible material and thereby furnish heat that will assist in and tend to stabilize or control the temperature of the carbonizing or other process going on in the adjacent hot zone. The solid ledges 9 and 11 act as heat reservoirs to help stabilize the temperatures of the various zones at desired levels.

Broadly speaking, the invention may be embodied in widely different structures. In FIGS. 1 and 2 the furnace walls could be thicker and the tunnels formed as longitudinal recesses in the walls themselves. Another example is shown in the furnace 101 of FIG. 3, which has an outer casing 103 with an internal structure providing housing means forming elongated tunnels 105 on one side facing elongated tunnels 107 on the other side. The tunnels 105 and 107 are formed in the mass or pile 109 of particulate material by pairs of log-like beams 111 which are laid across perpendicularly intersecting pairs of log-like beams 113 to build up a hollow crib-like structure 115. The sides 117 and 119 of this structure may be spaced from the walls of the casing 103 to provide vertical chambers 121 and 123 that communicate with the open spaces located between vertically spaced pairs of beams 111 and with the tunnels 105 and 107 forming the opposite ends of such spaces. The vertical chamber 121 is illustrated as an air inlet chamber and the vertical chamber 123 as an outlet chamber for connection to the exhaust stack (not shown) of the furnace. Thus, in operation, combustion air enters the tunnels 105 and flows into the pile 109 to form hot zones such as indicated at 125. Gases evolved in the zones are released or vented by means of tunnels 107 through which they pass to reach the exhaust chamber 123. Lances, such as shown at 127, may be provided in the vent tunnels 107 to furnish combustion air (as well as fuel water, or steam) for burning of any combustible gases reaching the tunnels 107 and to provide a means to control the temperature of the hot zone 125. If desired, air, fuel, water, or steam lances may be provided on the opposite side of the furnace for the inlet tunnels 105 to furnish a further means for individually controlling the hot zones formed adjacent and between respective pairs of tunnels 105 and 107.

It is apparent that the tunnels 105 and 107 of the furnace 101 could be used in the same manner as the tunnels 27 and 29 of furnace 1 of FIG. 1 (and vice versa), i.e., each being used as a collection chamber. Fig. 3, however, illustrates the concept that air and gases can flow from one tunnel to another and that a hot zone can be defined and controlled by two or more tunnels. Additionally, it will be recognized that with the use of air lances, the furnace 101 of FIG. 3 could be turned inside-out, i.e., the mass of particulate material could be on the outside of the structure 115 and the hollow center chamber of the structure 115 could then serve as an outlet chamber for released gases and a combustion chamber for any combustibles. In this method of use tunnels formed by the beams 111 and 113 would serve to facilitate release and collection of gases from the various hot zones.

FIG. 4 illustrates another structure 201 which has housing means to form collection zones 203. In this instance inclined flanges 205 are secured to the furnace wall 207 so that the particulate material forms an interface 209 defining one face of the tunnel 203. An outlet opening 211 in wall 207 provides means for escape of gases of the stack and a lance 213 provides means for admission of air, fuel, steam, or water to control the size, shape, and temperature of the hot zones. The structure 201 may, for example, be substituted for the ledge structure 9 and 11 of furnace 1 in FIG. 1.

As is evident from FIGS. 1 and 2 it is preferred that the tunnels be quite long but that opposite tunnels be relatively close together across the width of the furnace, i.e., the furnace be in the shape of a relatively narrow and long rectangle. This configuration gives a large efficient capacity with minimum difficulties due to bridging of the particulate material. However, many other cross sectional shapes may be successfully used with the invention and moving baffles may be employed, especially in the upper part of the furnace to prevent bridging.

FIG. 5 illustrates a different tunnel or collection chamber forming structure 301 in the form of housing means shaped as a circular or elongated inverted pot 303 that forms the collection chamber 305. The pot 303 may be buried in the pile 307 of particulate material and contain the outlet end of an air, fuel, water or steam lance 309 and a gas outlet stack 311. The pressure of incoming air will depress the particulate material to some degree as indicated by interface 313 and form a hot zone as indicated by line 315. One or more pot structures 303 may be used in a furnace and the pot concept is well adapted for use with an outdoor type furnace (no outer casing) as indicated by the structure of FIG. 6.

In FIG. 6 there is a pile 401 of particulate material and embedded in an outer surface of it is the bottom edge of an inverted, elongated trough or pot structure 403 that forms an elongated gas collecting vent chamber or tunnel 405. Air, fuel, water, or steam inlet means in the form of lances 407 extend through the base wall 409 of the pot 403 and gas outlet ports 411 are also formed in the wall 409. The interface 413 between the pile 401 and chamber 405 below the air lance 407 will tend to be depressed as shown and a hot zone adjacent the lance is illustrated by line 415.

In the various modifications there is a combination gas venting, collecting, and burning zone or tunnel that borders on and is substantially coextensive with and communicating with a hot zone through an outer surface of the pile or mass of particulate material. This zone for removing gas acts in combination with means for putting air into the mass and zone and several air admission arrangements, or combinations of arrangements, may be used. Thus, air jets may blow across the tunnel as illustrated by lances 53 or into the mass to a desired depth as illustrated by lances 55. Air may enter one group of tunnels and gas may escape through a different group of tunnels as illustrated in FIG. 3. Additionally, one end of a tunnel could be open to atmosphere or pressurized air and the other end of the tunnel open to the low pressure exhaust stack so that the air and gas flowing through the tunnel toward the stack end will sweep over the surface interface of the mass and be sucked into the mass to some degree as gas evolved in the mass flows toward lower pressure portions of the tunnel.

The admission of air, steam, water, or fuel individually to the respective vent chambers and/or hot zones together with control of the rate of material flow through the zones provides means for individually controlling the zones so that they function at desired temperatures and are of desired size and position (substantially stationary). Thus, the furnace of FIG. 1, for example, is, in effect, a series of small furnaces encased in a mass of material being processed. The collection chambers may, as illustrated, be formed in various ways to control the size, location, and operation of the hot zones. For further example, hollow elongated heat-resisting conduits with appropriate openings to admit evolved gases may be used against a surface of the pile to provide the tunnels.

Other modifications may be made without departing from the spirit and scope of the invention.

I claim:

1. In a furnace for the controlled combustion of a mass of carbonaceous particulate material, a furnace housing having an inlet at one end for material to be treated and an outlet at the other end for treated material, means for supporting said material in a pile in said furnace housing so that said material can flow from the inlet to the outlet, means in said housing providing a series of vent chambers spaced from each other in the direction of flow of material, said furnace including an exhaust stack, outlet means for said vent chambers connecting said chambers to said stack, and means for admitting combustion air to the pile and to the chambers, said stack including a downflow portion and an upflow portion and means for the admission of air to the stack to provide for the combustion of combustible gases in the stack.

* * * * *